US006006955A

United States Patent [19]

Bouix

[11] Patent Number: 6,006,955

[45] Date of Patent: Dec. 28, 1999

[54] PUMP PACKAGE

[75] Inventor: Herve F. Bouix, New York, N.Y.

[73] Assignee: Color Access, Inc., Melville, N.Y.

[21] Appl. No.: 09/078,289

[22] Filed: May 13, 1998

[51] Int. Cl.[6] ..... B67D 5/40

[52] U.S. Cl. ..... 222/373; 222/152; 222/321.9; 222/385; 222/394

[58] Field of Search ..... 222/373, 321.1, 222/152, 321.7, 321.9, 385, 394, 4, 631, 632, 633, 399; 128/202.25, 202.26, 203.16, 203.17, 204.13, 205.21, 200.14, 200.16; 239/53, 55; 261/DIG. 7

[56] References Cited

U.S. PATENT DOCUMENTS 5,485,828 1/1996 Hauser ..... 128/200.16

*Primary Examiner*—Henry J. Recla
*Assistant Examiner*—Peter deVore
*Attorney, Agent, or Firm*—Kenyon & Kenyon

[57] ABSTRACT

A dispensing system is provided which assists in preventing oxidation of a product having an oxygen labile component. The system comprises a container having an internal chamber and a neck providing access to the internal chamber. A pump is attached to the neck of the container. The pump projects into the internal chamber. A gas producing structure is attached to a portion of the pump that projects into the container. By one or more mechanisms, the gas producing structure gradually releases a gas, such as carbon dioxide, nitrogen, or any other gas that is substantially unreactive with the labile component of the product. The released gas provides two advantages. First, the gas serves to keep internal pressure of the system at a constant level. Second, the gas released is one which will not degrade labile components of the product. The ability of this dispensing system to at least partially fill the headspace of the package with a gas that does not readily degrade the labile component of the product aids in slowing down the degradation of that product. Therefore, since oxygen is displaced by released gas in the headspace, the oxidation process is slowed.

39 Claims, 1 Drawing Sheet

PUMP PACKAGE

FIELD OF THE INVENTION

The present invention relates to pump packages. More particularly, it relates to pump packages which assist in preventing the degradation of a biologically susceptible component of the product contained within the package.

BACKGROUND OF THE INVENTION

For the convenience and ease of dispensing, products are very often sold in pump packages. These packages comprise a container for the product and a pump for dispensing the product from the container. The basic function of most pumps is based on displacement of the product. Valves open and close in order to transfer product from a reservoir to the point of application. Most pumps share the same construction principles in that they have a central reservoir that collects and holds the product for dispensing, and a piston within the reservoir which provides a passageway to the dispensing point. The piston is the main component that pressurizes the product within the reservoir before dispensing.

The general sequence of functions to dispense product from a pump is as follows: With the pump on a container, and the container filled with the product to be dispensed, the first action is depression of the actuator of the pump. This moves the piston, which is attached to the actuator, down into the reservoir, compressing the product within the reservoir. The compressed product lifts a top valve within the piston, allowing the product to pass out of the actuator. As the actuator and piston return to the starting position, a vacuum is formed in the reservoir which closes the top valve. As the vacuum increases, a bottom valve, at the base of the reservoir, opens allowing the product to be pulled into the reservoir from the container. The continual opening and closing of the valves, under compression and vacuum, pushes the product through the system. By design, the flow of the product is in one direction, pulling product up into the reservoir, and then displacing it out through the actuator.

Because the product is pulled from the container, thereby decreasing the amount of product within the container, a vacuum is created within the container. If this vacuum is allowed to build up, the pump ceases to function at the point where the vacuum within the container equals the force required to pull the product into the reservoir. Therefore, at the time the bottom valve opens to fill the reservoir with product, a passageway opens between the container and the outside atmosphere. This passageway allows the vacuum within the container to dissipate so that the contents within the container can be kept at the same pressure as that of the outside atmosphere, thereby never allowing a vacuum pressure to be reached which would cease pump function. This process is known as "venting" and allows oxygen to enter into the container to equalize the pressure.

Products that contain labile components, such as fragrances, biologically active materials, fats, oils, or any other components that react with oxygen, tend to have their characteristics change over time with exposure to oxygen. This happens because certain components of the product degrade when exposed to oxygen. That is, when the product contacts the air, the labile component oxidizes and changes character, e.g., either by a loss of activity, or an alteration in odor or appearance. When products are placed within a container with a venting pump, the product is continually exposed to oxygen as the product is dispensed. This presents a particular problem when the product contains one or more labile components. Over time, this continual exposure to the air causes the labile component of the product to oxidize, thus changing the characteristics of that product.

The present invention provides a dispensing system that assists in preventing the oxidation of biologically active components of a product.

The present invention further provides a dispensing system that will not interfere with package aesthetics.

Also, the present invention provides a dispensing system that is inexpensive to manufacture.

Further, the present invention provides a dispensing system that is simple for a consumer to operate.

SUMMARY OF THE INVENTION

The present invention provides a dispensing system which assists in preventing the oxidation of a product having an oxygen labile component. The system comprises a container having an internal chamber and a neck, said neck providing access to the internal chamber of the container, a pump attached to the neck of the container, said pump projecting into the internal chamber; and a gas producing means attached to the portion of the pump projecting into the container.

By one or more mechanisms, the gas producing means gradually releases its gas, such as carbon dioxide, nitrogen, or any other gas that is substantially unreactive with the product's labile component. This released gas provides two advantages. First, the gas serves to keep the internal pressure of the system at a constant level. Second, the gas released is one which will not degrade labile components of the product.

The ability of this dispensing system to at least partially fill the headspace of the package with a gas that does not readily degrade the labile component of the product, aids in slowing down the degradation of that product. Therefore, since oxygen is not allowed to fully occupy the headspace, the oxidation process is slowed.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

Figure 1:
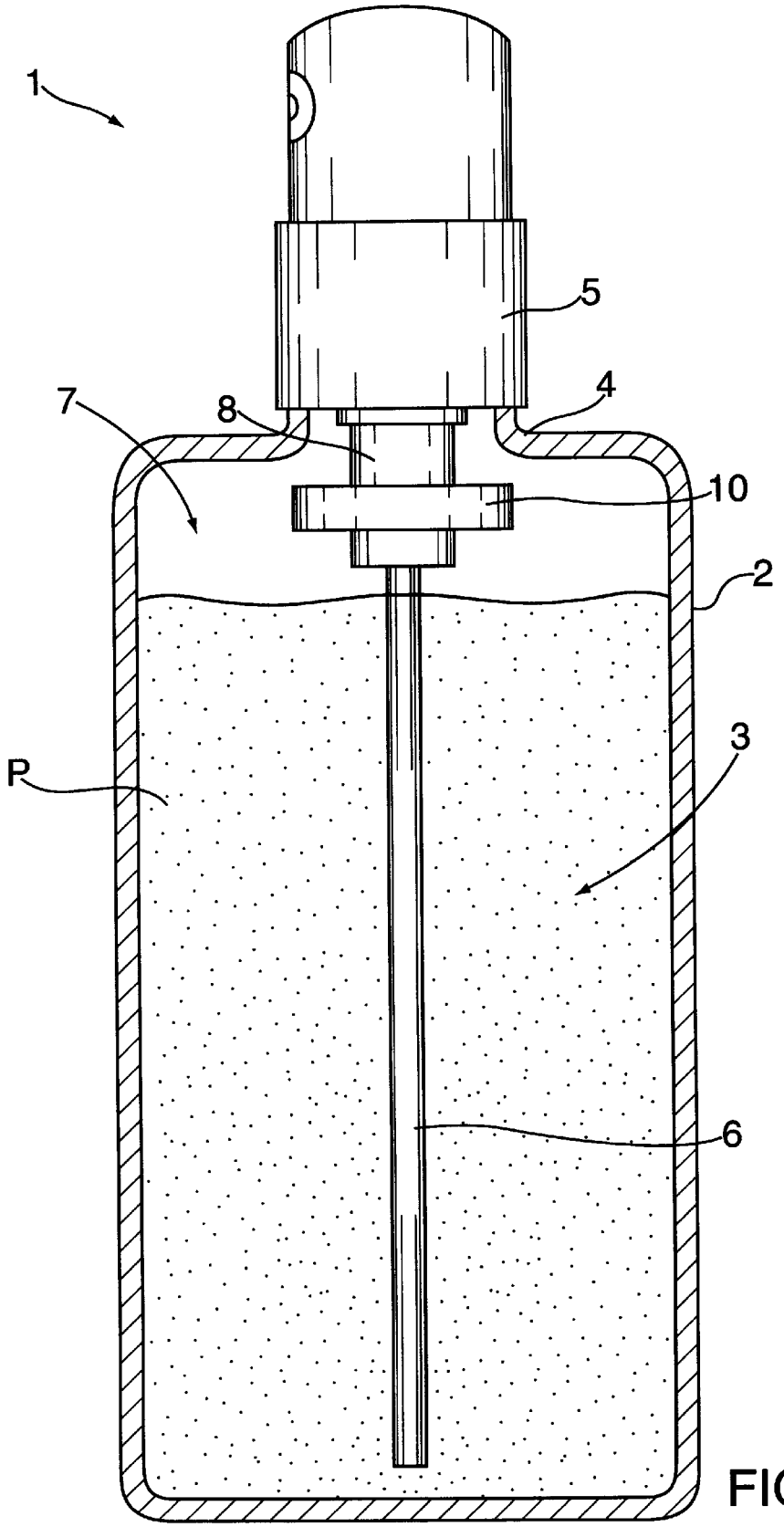
FIG. 1 is a partial cross-sectional view of the dispensing system of the present invention.

FIG. 1 generally shows the dispensing system 1 of the present invention. The dispensing system 1 comprises a container 2 having an internal chamber 3 and a neck 4, said neck 4 providing access to the internal chamber 3 of the container 2. The neck 4 is provided with a means for attaching a pump 5 thereto. The means for attaching the pump 5 to the neck 4 of the container 2 can be such means as opposing threads, snap engagements, crimping engagements, and the like, such means being well known within the art.

Depending on the type of product to be contained within the container, the container's composition materials may vary. The material comprising the container is not of critical importance to the present invention, but rather will be chosen based upon aesthetic and compatibility considerations rather than functional requirements of the pump system. For example, if any component of the product reacts with plastic, the preferable container material will be glass.

The pump 5, which dispenses product P from the internal chamber 3 of the container 2, is attached to the neck 4 of the container. Typically, these pumps use a dip tube 6 to dispense product from the bottom of the container, but pumps which do not use a dip tube can also be used. Suitable pumps for use with the present invention are those which are capable of dispensing lotions or liquids.

Normally, these pumps are provided with a means of venting the headspace 7 of the container after dispensing. The headspace 7 is that volume of space within the container which is not occupied by the product P. With the present invention, it is possible to use venting as well as non-venting pumps. A venting pump can be used when the efficiency of prevention of degradation is not a major consideration, for example, if the components of the product are not excessively oxygen labile. In this instance, the gas producing means and the venting function of the pump will both cooperate to fill the headspace of the container, the vent providing air from the outside atmosphere, and the gas producing means providing a gas which will not react with the product, thereby slowing down, but not necessarily eliminating the degradation process.

However, when the product contains a highly labile component, it is preferable to use a non-venting pump. Here, the non-venting pump does not provide access to the outside atmosphere, thereby eliminating the introduction of oxygen into the container. The gas producing means is the sole source by which to fill the headspace of the container.

In one embodiment, the gas producing means, shown generally as 10 in FIG. 1, comprises a solid form of bicarbonate, for example, an alkali metal bicarbonate such as sodium bicarbonate, within a solid matrix, which allows sufficient contact between the product and the bicarbonate to permit gas to escape upon contact, but which also preferably prevents a complete and immediate dissolution of the solid bicarbonate. As an example, such an article is formed by injection molding a plastic matrix, then compression molding the alkali metal bicarbonate about the matrix. The matrix provides support to the structure, while the bicarbonate material is exposed so that it can react with a water component of the product to produce carbon dioxide gas. Alternatively, the matrix can be a wire or plastic mesh basket, enclosing a solid bicarbonate tablet. In this embodiment, some contact between the solid bicarbonate and an aqueous component of the product contained in the container, is required to release the carbon dioxide gas from the bicarbonate. This can readily be accomplished by occasional shaking of the container containing the product.

In a second embodiment, the gas producing means 10 is a porous material containing entrapped gas, which material is then surrounded by a degradable film. To construct this type of structure, the porous material, such as a porous plastic, a porous metal, a porous plastic mixed with clay or chalk, compressed textiles, or plastic mixed with argil, is placed under a vacuum, and then injected with a gas, such as nitrogen or carbon dioxide. In this way, the gas is entrapped in the pores. The porous material with entrapped gas is then covered with a layer of a degradable film, such as polyvinyl alcohol (PVA), ensuring at least temporary retention of the gas within the porous material. Any product compatible degradable film may be used, even if degradation occurs only with aqueous contact; however, PVA is particularly suitable in that it gradually degrades over time, with or without contact with an aqueous medium. A relatively slow degradation will occur without aqueous contact, whereas degradation is accelerated by contact with water. However degradation occurs, gas is gradually released into the container's headspace.

Other degradable films contemplated for use with the present invention include, but are not limited to, natural and synthetic water-soluble films such as, for example, methyl cellulose, carboxymethyl cellulose, hydroxyethyl cellulose, hydroxypropyl cellulose, and like cellulose ethers; and synthetic polymers, such as polyoxyethylene, polyvinyl methyl ether, polyvinyl alcohol, polyacrylamide, polyvinyl pyrrolidone, polyacrylic acid, polymethacrylic acid, and the like.

In most cases, the gas producing means 10 will be preferably positioned within the container 2 such that the product P can contact the gas producing means 10. For example, the gas producing means 10 can be positioned on the body 8 of the pump 5 where the product P can contact the gas producing means 10 when the product is agitated within the container 2. After the product contacts the gas producing means, the water component of the product causes the gas producing means to release a gas. Any discharged gas which does not aggressively react with the labile component of the product, such as nitrogen gas or carbon dioxide gas, is suitable. To enable the production of carbon dioxide gas, for example, an alkali metal bicarbonate compound in solid form, such as sodium bicarbonate, is placed within the container of the present invention to serve as the gas producing means. The bicarbonate compound is positioned within the container such that the product is capable of contacting that compound during normal handling of the container before dispensing. When the product is brought into contact with the compound, the water portion of the product reacts with the bicarbonate compound and causes the release of carbon dioxide gas. The released carbon dioxide gas fills the headspace 7 of the container 2 with a gas that does not readily degrade the labile component of the product P. Also, the released gas assists in dissipating the vacuum created by the dispensing of product. When used with a venting pump, the released gas fills the volume of the headspace of the container that is not filled with the vented air. With a non-venting pump, the gas fills the headspace with an amount of gas approximately equal to the volume that was formerly occupied by the product which was dispensed.

It may also be desirable to incorporate into the dispensing system one or more oxygen scavengers or antioxidants. Examples of useful compounds for this purpose include, but are not limited to, propyl gallate, ascorbic acid and derivatives thereof, tocopherol and derivatives thereof, NDGA, BHA, BHT, and/or sequestering agents such as citric acid or EDTA, and mixtures thereof. The scavenger/antioxidant can be positioned in a number of different locations within the package. In a preferred embodiment, it will be incorporated as part of the gas producing means. However, it may also be incorporated into the cap, within the container, or into the formulation itself.

The present invention, and its broader aspects, is not intended to be limited to the specific examples shown and described; rather, various modifications will be suggested to those skilled in the art, all of which are within the scope of the present invention.

What is claimed is:

1. A dispensing system, comprising:

a container having a neck and an internal chamber adapted to contain a product, a portion of the internal chamber defining a head space, said neck providing access to the internal chamber of the container;

a pump adapted to dispense the product from the internal chamber, said pump attached to the neck of the container, said pump adapted to project into the product within the internal chamber of the container; and a gas producing means having a structure adapted to gradually release a gas, the gas producing means placed within the container in fluid communication with the headspace.

2. The dispensing system of claim 1 wherein a product having an oxygen labile component is placed within the internal chamber of the container.

3. The dispensing system of claim 2 wherein the gas producing means produces a gas which does not degrade the labile component of the product.

4. The dispensing system of claim 3 wherein the gas is carbon dioxide or nitrogen.

5. The dispensing system of claim 1 wherein the pump is a non-venting pump.

6. The dispensing system of claim 1 wherein the pump is a venting pump.

7. The dispensing system of claim 1 wherein the gas producing means is attached to the pump.

8. The dispensing system of claim 1, wherein the gas producing means comprises a solid form of bicarbonate within a solid matrix.

9. The dispensing system of claim 8 wherein the solid form of bicarbonate is an alkali metal bicarbonate.

10. The dispensing system of claim 9 wherein the alkali metal bicarbonate is sodium bicarbonate.

11. The dispensing system of claim 1 wherein the gas producing means comprises a porous material containing entrapped gas.

12. The dispensing system of claim 11 wherein the porous material is chosen from the group consisting of porous plastics, porous metals, a porous plastic mixed with clay or chalk, compressed textiles, and plastic material mixed with argil.

13. The dispensing system of claim 11 wherein the porous material is then surrounded by a degradable film.

14. The dispensing system of claim 13 wherein the degradable film is chosen from the group consisting of methyl cellulose, carboxymethyl cellulose, hydroxyethyl cellulose, hydroxypropyl cellulose, polyoxyethylene, polyvinyl methyl ether, polyvinyl alcohol, polyacrylamide, polyvinyl pyrrolidone, polyacrylic acid, and polymethacrylic acid.

15. The dispensing system of claim 14 wherein the degradable film is polyvinyl alcohol.

16. The dispensing system of claim 1 wherein one or more oxygen scavengers or antioxidants are incorporated into the dispensing system.

17. The dispensing system of claim 16 wherein the oxygen scavengers or antioxidants are chosen from the group consisting of propyl gallate, ascorbic acid and derivatives thereof, tocopherol and derivatives thereof, NDGA, BHA, BHT, sequestering agents, and mixtures thereof.

18. A dispensing system for an oxygen labile product which comprises:

a container having a neck and an internal chamber, said neck providing access to the internal chamber of the container;

a pump attached to the neck of the container, said pump projecting into the internal chamber of the container; and a gas producing means placed within the container, said means comprising a solid form of bicarbonate within a solid matrix.

19. The dispensing system of claim 18 wherein a product having an oxygen labile component is placed within the internal chamber of the container.

20. The dispensing system of claim 18 wherein the pump is a non-venting pump.

21. The dispensing system of claim 18 wherein the pump is a venting pump.

22. The dispensing system of claim 18 wherein the gas producing means is attached to the pump.

23. The dispensing system of claim 18 wherein the solid form of bicarbonate is an alkali metal bicarbonate.

24. The dispensing system of claim 23 wherein the alkali metal bicarbonate is sodium bicarbonate.

25. The dispensing system of claim 18 wherein one or more oxygen scavengers or antioxidants are incorporated into the dispensing system.

26. The dispensing system of claim 25 wherein the oxygen scavengers or antioxidants are chosen from the group consisting of propyl gallate, ascorbic acid and derivatives thereof, tocopherol and derivatives thereof, NDGA, BHA, BHT, sequestering agents, and mixtures thereof.

27. A dispensing system for an oxygen labile product which comprises:

a container having a neck and an internal chamber adapted to contain the oxygen labile product, a portion of the internal chamber defining a head space, said neck providing access to the internal chamber of the container;

a pump adapted to dispense the oxygen labile product from the internal chamber, said pump attached to the neck of the container, said pump projecting into the internal chamber of the container; and a gas producing means having a structure adapted to gradually release a gas, the gas producing means placed within the container in fluid communication with the headspace, said means comprising a porous material containing entrapped gas.

28. The dispensing system of claim 27 wherein the porous material is then surrounded by a degradable film.

29. The dispensing system of claim 28 wherein the degradable film is chosen from the group consisting of methyl cellulose, carboxymethyl cellulose, hydroxyethyl cellulose, hydroxypropyl cellulose, polyoxyethylene, polyvinyl methyl ether, polyvinyl alcohol, polyacrylamide, polyvinyl pyrrolidone, polyacrylic acid, and polymethacrylic acid.

30. The dispensing system of claim 29 wherein the degradable film is polyvinyl alcohol.

31. The dispensing system of claim 27 wherein a product having an oxygen labile component is placed within the internal chamber of the container.

32. The dispensing system of claim 27 wherein the pump is a non-venting pump.

33. The dispensing system of claim 27 wherein the pump is a venting pump.

34. The dispensing system of claim 27 wherein the entrapped gas is a gas which does not degrade the labile component of the product.

35. The dispensing system of claim 32 wherein the gas is carbon dioxide or nitrogen.

36. The dispensing system of claim 27 wherein the gas producing means is attached to the pump.

37. The dispensing system of claim 27 wherein the porous material is chosen from the group consisting of porous plastics, porous metals, a porous plastic mixed with clay or chalk, compressed textiles, and plastic material mixed with argil.

38. The dispensing system of claim 27 wherein one or more oxygen scavengers or antioxidants are incorporated into the dispensing system.

39. The dispensing system of claim 38 wherein the oxygen scavengers or antioxidants are chosen from the group consisting of propyl gallate, ascorbic acid and derivatives thereof, tocopherol and derivatives thereof, NDGA, BHA, BHT, sequestering agents, and mixtures thereof.

* * * * *